United States Patent [19]

Trudeau

[11] Patent Number: 4,702,170

[45] Date of Patent: Oct. 27, 1987

[54] SHOTSHELL CARTRIDGE ADAPTER

[76] Inventor: Ronald E. Trudeau, Star Rte. #85, Ashfield, Mass. 01330

[21] Appl. No.: 918,559

[22] Filed: Oct. 14, 1986

[51] Int. Cl.[4] ..... F42B 5/02; F42B 9/02

[52] U.S. Cl. ..... 102/446

[58] Field of Search ..... 102/444, 446, 213

[56] References Cited

U.S. PATENT DOCUMENTS 3,722,125 3/1973 Switzer ..... 42/89

FOREIGN PATENT DOCUMENTS 23615 of 1907 United Kingdom ..... 102/446

5606 of 1911 United Kingdom ..... 102/446

2149070 6/1985 United Kingdom ..... 102/446

*Primary Examiner*—Harold J. Tudor

*Attorney, Agent, or Firm*—Donald S. Holland

[57] ABSTRACT

A shotshell cartridge adapter is disclosed that enables safe firing of subcaliber rim-fire shot cartridges in conventional shotguns. In the preferred embodiment, the invention comprises an outer hull shaped like a standard shotgun shell; an adapter tube fixed within the hull; and a cylindrical firing pin mechanism removably housed within the lower end of the tube. This firing pin mechanism has a recessed piston-shaped firing pin with a chisel-pointed protrusion that strikes a shot cartridge loaded in the adapter.

7 Claims, 4 Drawing Figures

SHOTSHELL CARTRIDGE ADAPTER

BACKGROUND OF THE INVENTION

The present invention relates to a novel shotgun cartridge adapter that enables safe firing of subcaliber rim-fire shot cartridges in a standard shotgun.

Small-caliber, low-power shot pellet charges have always been useful for various sporting purposes as well as for elimination of small pests. Their relatively short range and limited power make them safe to use in circumstances where bullet charges would be prohibitively dangerous. For example, small-caliber, shot charges allow for use in confined areas and populated areas. This makes the ammunition especially desirable for shooting birds or other small game, or for target shooting and training young shooters.

A major advantage of the small (typically, .22 caliber) rim-fire, shot cartridge is its substantially lower cost compared to virtually all other larger caliber, more powerful types of ammunition. However, a major disadvantage is its effective use requires a non-rifled, smooth-bored firearm. Unfortunately, such smooth-bored weapons are not commonly available and tend to be prohibitively expensive.

Consequently, prior attempts have been made to develop an adaptive cartridge to allow for the safe use of this ammunition in conventional shotguns. Likewise, attempts have been made to produce adaptive cartridges for use with subcaliber rim-fire bullet cartridges in both rifled firearms and smooth bore shotguns. The primary incentive for development of bullet cartridge adapters is the low cost of the subcaliber ammunition; it makes practice shooting far less expensive. A secondary incentive is the occasional desire to target small game while hunting large game with the same gun.

All of these cartridge adapters, or "inserts", as they are sometimes called, suffer from several significant problems—the most significant of which is an increased danger of accidental discharge.

The safety concern with all cartridge adapters is substantially more significant than the similar concern for ammunition alone. All firearm ammunition present potential hazards and must be treated with care to prevent accidental detonation prior to being loaded in a gun. In the event of accidental detonation, by burning, crushing or occasionally by dropping, all ammunition will explode. Because the shell containing the explosive powder is not contained within a gun's breech and because there is no bore and muzzle to allow for sustained, controlled, rapid, gas expansion behind the shot pellets or bullet, the pellets or bullet will not travel a significant distance with any force. The effect is more like a "firecracker" than a gun. The danger is limited to the immediate proximity of the exploding ammunition.

Cartridge adapters, however, present a much more dangerous situation. For example, see the cartridge adapters presented in U.S. Pat. Nos. 2,352,476 to French; 3,598,053 to Glater; 3,640,013 to Franklin; 4,418,488 to Hughes; and 4,430,940 to Jermunson.

First, since the ammunition is invariably encased within the adapter, a breech is formed, even if the adapter is not inserted within the firearm. Second, many cartridge adapters locate the ammunition toward the rear of the cartridge, providing, in effect, a breech, bore and muzzle within the adaptor itself. Third, all cartridge adapters have substantially greater weight than the ammunition itself. This significantly increases the potential force upon impact to the encased ammunition in the event the loaded cartridge adapter is dropped. Fourth, most cartridge adapters, in order to load the subcaliber ammunition into the cartridge, involve a pressured insertion of a firing pin mechanism upon the ammunition, or a screwing together of two cartridge subparts, one of which contains the ammunition.

Consequently, the likelihood of accidental detonation is dramatically increased. Any debris of prior firings or a foreign body within the cartridge adapter could cause increased pressure upon the ammunition, sufficient for detonation, when the adapter is being loaded or assembled. Dropping the loaded cartridge adapter, because of its total weight, could direct sufficient force for detonation on the exposed surfaoe of the firing pin mechanism. If accidental detonation occurs, because the ammunition is encased within a breech, the shot pellets or bullet will discharge with potentially catastrophic force to the user or anyone nearby.

The two most important factors in enhancing cartridge adapter safety, therefore, are limiting the exposed surface area of the firing pin mechanism and limiting the presence of debris from prior firing, or foreign substances within the cartridge adapter. Both of these factors are complicated by the need to produce a cartridge adapter which directs the detonating force of the "center-fire" firing pin for large-caliber firearms to the rim of the subcaliber "rim-fire" ammunition within the cartridge adapter.

Early designs, such as the aforementioned U.S. Pat. Nos. 2,352,476 to French and 3,640,013 to Franklin, maximized the danger by simply positioning the subcaliber ammunition eccentrically within a normal caliber cartridge. The position was such that the "center-fire" firing pin was aligned with the rim of the subcaliber ammunition. No secondary firing pin mechanism was used and the entire rim area of the subcaliber ammunition was exposed. The result was a very dangerous cartridge adapter, highly susceptible to discharge upon impact, as opposed to assembly. Further, it should be noted that such eccentric positioning of a pellet shot cartridge within a rifled shotgun bore would inherently result in inferior shot-pattern uniformity and inaccuracy due to a skewed pattern center.

Later models, such as U.S. Pat. Nos. 3,598,053 to Glater and 4,418,488 to Hughes, utilizing secondary firing pin mechanisms, attempted to centrally locate the subcaliber ammunition and direct the force of the "center-fire" firing pin to the rim of the subcaliber ammunition. These cartridge adapters typically suffer from a problem related to the secondary firing pin mechanism. The force from the "center-fire" firing pin is usually translated to chisel-pointed forks travelling along channelled cylinders or chisel-pointed cylinders, which impact the rim of the subcaliber ammunition causing detonation. These systems fail to provide sufficient backup for the subcaliber ammunition to adequately preclude rupture of its brass base upon firing. Any rupture of the ammunition's base will subject the firing pin mechanism to blow back of gases and powder residue which could result in subsequent misfires. This also will increase the probability of an inadvertent discharge upon assembly resulting from accumulation of residue and debris.

Some later cartridge adapters have solid base plates through which a secondary firing pin passes to impact the rim; e.g., see U.S. Pat. No. 4,430,940 to Jermunson. However, in order to load these adapters a large firing pin mechanism is pressure inserted behind the subcaliber ammunition. Unfortunately, this creates a substantial risk of an accidental assembly discharge, when a foreign particle becomes lodged between the ammunition's base and the firing pin mechanism.

Further, the width of the removable firing pin mechanism in Jermunson is the same as the width of the subcaliber ammunition. Although the pin itself is narrower, the entire mechanism is in direct contact with the entire rim of the subcaliber ammunition. This, too, greatly enhances the possibility of an impact accidental discharge.

Those cartridge adapters with high degrees of accidental discharge outside the firearms are also extremely dangerous within firearms that utilize an ammunition storage system of individual cartridges stored end to end. This is common in "lever-action" rifles and "pump-action" rifles and shotguns. An impact initiated accidental discharge within the magazine could produce a chain reaction discharge of the forward, normal caliber ammunition with disasterous results.

The danger is even more substantial in "semi-automatic" or "auto-load" firearms. The spring-loaded mechanism, as used in these firearms, must be manually cycled when firing subcaliber ammunition in a cartridge adapter due to the lower than normal firing pressures.

When such a mechanism is released or actuated manually, the high breech closing forces (impacting such an adapter contained cartridge) can be sufficient to cause accidental discharge. This is particularly the case if a slamming bolt face contained contaminate grit and were to impact a firing pin of such a diameter that exceeds that of the firearms' receiver or bolt firing pin clearance diameter.

Those cartridge adapters with secondary firing pin mechanisms, wherein the subcaliber ammunition's base is inadequately supported, have reliability problems resulting from the blowback of explosive gases and debris. This leads to a high number of misfires with prolonged use. Cartridge adapters utilizing firing pin mechanisms, wherein a narrow pin travels laterally from the center to the rim through a narrow tube, have been found to be easily influenced by adverse environmental influences, leading to unpredictable performance.

Although the early, simple cartridge adapters, utilizing only eccentric positioning of the subcaliber rim-fire cartridge, would reliably discharge, the poor accuracy of these adapters produced an unreliable effect of the discharge.

Accordingly, it is the primary objeot of the present invention to provide an improved cartridge adapter which will enable a user to safely discharge subcaliber, rim-fire, shotshells in conventional shotguns.

It is another object to provide a reliable shotshell cartridge adapter which will not misfire unpredictably upon prolonged use.

It is yet another object to provide a shotshell cartridge adapter which improves the effective accuracy of the discharged shot pellets.

It is a still further object to provide a shotshell cartridge adapter, commensurate with the above-listed objects, which is inexpensive to manufacture and easy to use and maintain.

SUMMARY OF THE INVENTION

A shotshell cartridge adapter is disclosed that provides improved safety, reliability, accuracy and economy. In its preferred embodiment the cartridge adapter comprises an adapter tube running the length of the cartridge adapter which is open at one end, the muzzle end. The muzzle end is surrounded by a donut shaped end cap.

The other end, the breech end of the adapter tube, has two vertically spaced shoulders: an upper one, closest to the muzzle end, which holds and retains the rim of the subcaliber rim-fire ammunition; and a lower one which holds the firing pin mechanism enclosed within the adapter tube.

This firing pin mechanism consists of a cylindrical breech bushing through which a recessed, piston shaped secondary firing pin passes to impact the ammunition rim. The impact point is a small, chisel-pointed protrusion near the rim of the firing pin's face.

The firing pin mechanism is retained within the adapter tube by a spring-loaded ball within the tube exerting pressure on a detent ring around the breech bushing. The entire adapter tube is encased within an outer envelope housing made from a conventional shotgun shell hull.

The invention minimizes the danger of an impact initiated accidental discharge because the exposed surface area of the secondary firing pin is both recessed and the area exposed is the smallest area possible. The possibility of an assembly initiated accidental discharge is limited by utilizing a piston-shaped secondary firing pin which reduces the likelihood of rupture of the ammunition base and consequent accumulation of explosive gas residue and debris. Additionally, the extremely short length of the firing pin mechanism decreases the likelihood of either rupture of the ammunition base or accumulaton of explosive gas residue and debris. This absence of accumulated residue and debris greatly enhances reliability upon prolonged use by allowing for unimpeded movement of the secondary firing pin upon firing.

Location of the adapter tube in the center of the shotgun shell hull (ergo, the center of the firearm's breech) produces improved performance and accuracy compared to adapters utilizing eccentric location of subcaliber ammunition. Utilization of conventional shotgun shell hulls for the outer envelope, as well as use of one firing pin mechanism in cartridge adapters of various gauges, allows for production-cost savings resulting in a relatively inexpensive, reliable, accurate and safe subcaliber rimfire, shotshell cartridge adapter.

DETAILED DESCRIPTION OF THE PREFERRED EMBODIMENT

Figure 1:
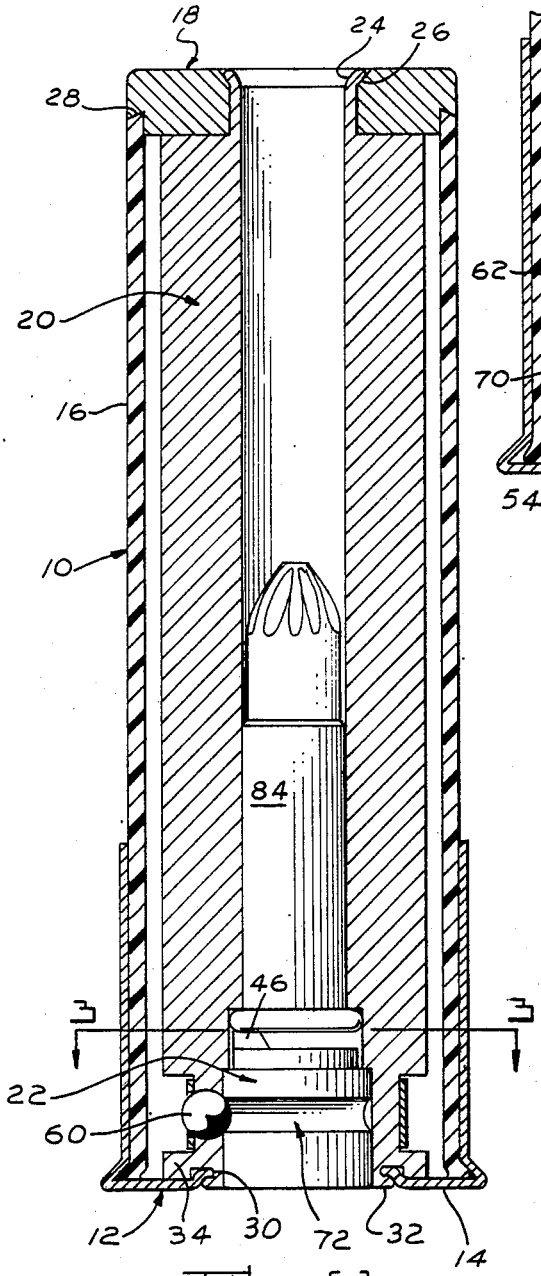
FIG. 1 is an elevational view of a cartridge adapter constructed in accordance with the present invention showing, partly in cross section, an adapter tube, subcaliber rim-fire ammunition, a firing pin mechanism and a shotgun shell hull.

Referring to the drawings in detail, the preferred embodiment of a subcaliber, rim-fire oartridge adapter is shown and generally designated by the reference numeral 10. As best shown in FIG. 1, the invention basically comprises a standard shotgun shell hull 12 having a thin metallic base 14 and a plastic tubular shell 16; a donut shaped muzzle end cap 18 pressed onto the top of shell 16; an adapter tube 20 within the shell; and a firing pin mechanism 22 within the lower or breech end of the adapter tube 20.

The adapter tube 20 is secured within the shotgun shell hull by a flared end 24 which secures the muzzle end cap 18 by overlying the cap's inverse conical upper edge 26. The end cap 18 extends over the plastic tubular shell 16 of the shotgun shell hull 12 so that the upward angle 28 on the outer bottom of the end cap 18 forces the plastic shell against the stepped edge 28 of the end cap 18.

Figure 2:
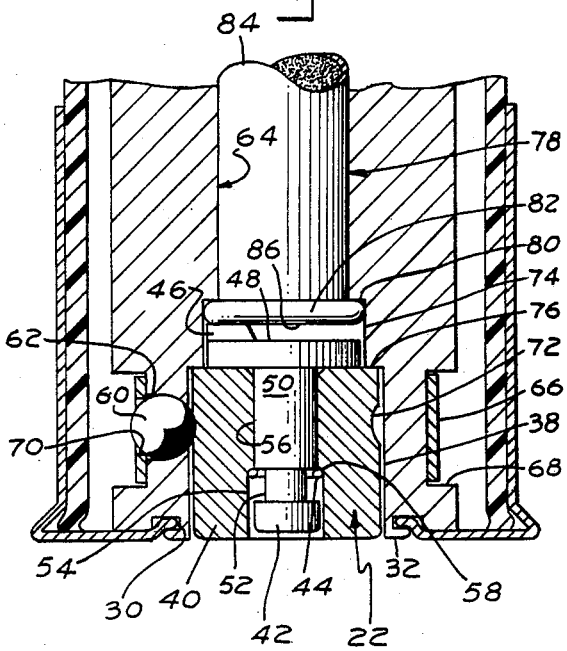
FIG. 2 is an enlarged fragmentary cross-sectional view of the bottom portion of FIG. 1, showing a secondary firing pin within the firing pin mechanism and the breech end of the cartridge adapter.
Figure 3:
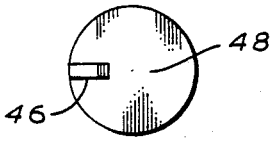
FIG. 3 is a top plan view of the top face of the secondary firing pin, taken along line 3-3 of FIG. 1, showing a chisel-pointed protrusion used to effect detonation.

As best shown in FIGS. 1 and 2, the adapter tube is secured within the breech end of the metallic base 14 of the shotgun shell hull 12 by a circular groove 30 surrounded by a projection 32 in the adapter-tube footing 34. Hull base 14 has an opening with essentially the same diameter as projection 32. The base 14 is crimp fitted within the groove 30 in the adapter footing. It is captured by roll fitting the projection 32 over the groove 30. This affixes the base to adapter tube 20.

Footing 34 encloses the firing pin mechanism 22 within a first passage section 38 of the adapter tube. Referring to FIG. 2, this firing mechanism consists of a breech bushing 40, a piston shaped secondary firing pin 42 and a spring ring 44. The secondary firing pin 42 comprises a chisel-pointed protrusion 46, a flat upper face 48, a stem or shaft 50, and a reduced diameter portion 52 of the shaft.

The breech bushing 40 contains a lower chamber 54 and a narrower upper chamber 56. The secondary firing pin 42 moves axially through these two chambers, 54 and 56, within a range of motion constrained downwardly because the upper face 48 of the firing pin is wider than the upper chamber 56 of the breech bushing. The movement of the firing pin 42 is constrained upwardly by the spring ring 44 being positioned within the lower chamber 54 at the shoulder 58 created by the beginning of the narrower, upper chamber 56 of the breech bushing 40.

Note that the spring ring 44 allows unimpeded upward movement of the firing pin 42 only through the distance of the reduced diameter portion 52 of the firing pin shaft 50. Further, because the movement is so constrained, the pin remains slidably housed within the breech bushing 40 during use of the firing pin mechanism 22.

Figure 4:
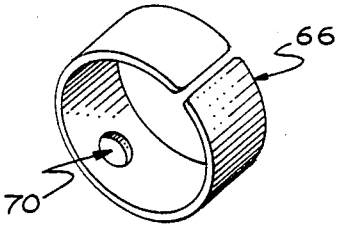
FIG. 4 is a perspective view of a split spring collar shown in cross section in FIG. 1.

As shown in FIGS. 2 and 4, the firing pin mechanism 22 is retained within the adapter tube 20 by a steel ball 60 held in a radially bored hole 62 in the adapter tube wall 64 by a split spring collar 66. This split collar lies within a relieved groove portion 68 of the adaptor tube wall 64. The bored hole 62 in the tube wall 64 is centered within the relieved groove 68; and the steel ball 60 is positioned between a hole 70 in the spring collar and the bored hole 62 in the adaptor tube wall.

In this illustrated embodiment, the diameter of collar hole 70 is sized to circumvent ball 60 to a depth of approximately twenty percent of the steel ball's diameter 60 (see FIG. 2). The bored hole 62 in the adapter tube wall 64 does not break completely through into the first passage section 38 of the adapter tube containing the firing pin mechanism 22, such that roughly twenty percent of the diameter of the steel ball 60 extends into that passage section 38 when the spring collar 66 applies pressure to the steel ball 60.

The breech bushing 40 of the firing pin mechanism 22 contains an annular groove 72 of substantially the same radius as that of the spring loaded steel ball 60. The depth of this groove 72 is approximately fifteen percent of the diameter of the steel ball 60. Upon insertion of the firing pin mechanism 22 into the first passage section 38 of the adapter tube, the steel ball 60 protruding into that passage 38 fits into the annular groove 72 of the breech bushing 40, capturing the firing pin mechanism by the tension of the spring collar 66 in a stable position.

The adapter tube contains a second passage 74 axially above the first pasasge 38 or closer to the muzzle end cap 18. The passage 74 is narrower than the first passage which creates a shoulder 76 between the two passages. This shoulder 76 limits the movement of the breech bushing 40 in the direction of the muzzle end cap 18. The secondary firing pin 50 shaft passes through the breech bushing so that the upper face 48 of the firing pin extends into the second passage 74.

Axially above the second passage 74 is the third and final passage 78 of the adapter tube 20. This third passage 78 is narrower than the second passage 74 and forms the chamber and barrel of the oartridge adapter 10. The third passage 78 forms yet another shoulder 80 with the second passage 74, which holds the rim 82 of the subcaliber rim-fire ammunition 84. When the cartridge adapter 10 is loaded with ammunition 84, the chisel-pointed protrusion 46 of the secondary firing pin 42 rests in contact with the rim 82 of the ammunition. The pressure of the spring collar 66 and steel ball 60 on the firing pin mechanism 22 holds the secondary firing pin 42 and ammunition in this static position until the cartridge adapter 10 is used.

Operation of the preferred embodiment of the cartridge adapter 10 commences when a user (not shown) takes the described cartridge adapter 10 loaded with ammunition 84 and inserts it into a conventional shotgun (not shown). Upon pulling the trigger of the shotgun, the primary firing pin (not shown) of the shotgun impacts the secondary firing pin shaft 50 forcing it to travel toward the muzzle end cap 18, causing the protrusion 46 of the secondary firing pin 42 to pinch the rim 82 of the ammunition 84. This produces a detonation and discharge of the shot pellets down the third passage 78 or barrel of the adapter tube 20 and out into the barrel of the firearm.

To reload the cartridge adapter 10, the user, after removing the adapter from the firearm, inserts a small rod (not shown) into the muzzle end of the adapter and exerts enough pressure on the rod against the spent shell casing to overcome the pressure of the spring collar 66. The firing pin mechanism 22 slips out followed by the spent shell casing. Another cartridge of subcaliber rimfire ammunition is inserted into the first passage 38 of the adapter tube, followed by the firing pin mechanism 22.

Gentle pressure on the firing pin mechanism 22 overcomes the spring collar 66 tension, securing the ammunition 84 and firing pin mechanism 22. The cartridge adapter is again loaded and ready to be used.

In operation, the cartridge adapter minimizes the danger of accidental impact initiated discharge by providing the smallest possible exposed surface area of the secondary firing pin 42. That surface area is of a diameter equal to or less than that of the bolt face firing pin housing (not shown) of the firearm in which the cartridge adapter is to be used.

Additionally, accidental assembly discharge is eliminated because the shoulder section 76 of the adapter tube passage section 38 limits the travel of the firing pin mechanism 22 and prevents external insertion forces upon bushing 40 from impinging upon firing pin face 48 and ammunition base 86. The danger of an accidental impact initiated discharge is further lessened because the exposed surface areas of the secondary firing pin 42 is recessed within the lower chamber 54 of the breech bushing 40. This eliminates the possibility of an accidental discharge resulting from impact of the cartridge adaptor upon a flat surface.

The danger of an accidental assembly initiated discharge is minimized because the piston shaped secondary firing pin upper face 48 is flat, except for the protrusion 46, and has a flat surface area equal to the area of the base 86 of the subcaliber ammunition 84. Because the entire base 86 is covered, little opportunity exists for a posible rupture of it and the consequent blowback of explosive gas and debris. By avoiding the residue, this prevents an artificial protrusion or extension of the firing pin, that could apply sufficient pressure on the ammunition during assembly to produce an accidental impact detonation.

The likelihood of such an accidental assembly initiated discharge is further limited by use of the extremely short firing pin mechanism 22. It reduces the possibility of unseen or unnoticed foreign bodies entering the cartridge adapter 10 when disassembled or during assembly. Such foreign bodies could act as firing pin protrusions, or cause the secondary firing pin to be extended upon assembly by lodging between the firing pin upper face 48 and the top of the breech bushing, thereby producing a detonation upon assembly.

The cartridge adapter 10 achieves a high degree of reliability and does not misfire upon prolonged use because the primarily flat upper face 48 of the piston shaped secondary firing pin 42 reduces the possibility of ammunition 84 rupture and blowback of explosive gases and debris. Accumulation of gas residue and debris would lead to inconsistent movement of the secondary firing pin and a high number of misfires. The very short design of the firing pin mechanism 22 limits the likelihood of unseen or unnoticed foreign bodies entering the cartridge adapter 10. The absence of such foreign bodies enhances reliability upon prolonged use, by providing for unobstructed movement of the secondary firing pin 42.

The shotshell cartridge adapter 10 achieves a high degree of accuracy because the ammunition 84 is located in the center of the breech of the firearm. Further, the enhanced accuracy is obtained because the cartridge adapter 10 allows the user to fire subcaliber rimfire shot ammunition 84 in smooth bore, muzzle-choked conventional shotguns. Such shotguns are specifically designed to excel in patterning of shot charges.

The cartridge adapter is designed such that its component parts, except the muzzle end cap 18, are interchangeable with cartridge adapters for all conventional shotgun gauges. This is because its components, the adapter tube 20 and the firing pin mechanism 22, all fit within conventional shotgun shell hulls of various gauges. This interchangability of components allows for significantly low production cost, and hence low consumer cost. The simplicity of the short firing pin mechanism design allows for easy cleaning of the type typically required for normal maintenance of bores exposed to powder burning residues.

It should be understood by those skilled in the art that obvious structural modifications can be made without departing from the spirit of the invention. For example, a spring-biasing means (such as a leaf-spring or spring-biased ball) could be used to removably retain the firing pin mechanism 22 rather than the ball-and-detent arrangement (60, 66, 70, 72) previously disclosed. Accordingly, reference should be made primarily to the accompanying claims rather than the foregoing specification to determine the scope of the invention.

Having thus described the invention, what is claimed is:

1. A cartridge adapter for firing subcaliber rim-fire shot cartridges in a standard shotgun, wherein the adapter comprises:

a. an adapter tube having upper and lower ends, wherein the tube has a central passageway that houses and totally encloses said subcaliber cartridge, said passageway having two stepped portions that successively widen the passageway adjacent the tube's lower end;

b. a firing pin mechanism removably located within the stepped portions by a ball-and-detent arrangement, said mechanism comprising:

i. a cylindrical breech bushing removably housed within the stepped portions, said bushing having a central throughbore;

ii. a secondary firing pin slidably housed within the bushing's throughbore, said secondary firing pin having a T-shaped piston configuration comprised of a vertical stem, slidably retained inside the throughbore by a spring-biased midportion, and an integral horizontal portion that normally sits atop the breech bushing, said horizontal portion having an upper face with a chisel-pointed protrusion along the rim of that face;

iii. wherein a free end of the stem is adjacent the lower end of the breech bushing but recessed slightly therefrom inside the throughbore;

c. wherein the adapter tube's passageway has an annular shoulder vertically spaced above the chisel-pointed protrusion for removably retaining the base of subcaliber ammunition between the protrusion and the shoulder, whereby said base is normally spaced apart and above the entire upper face of the secondary firing pin except for that portion resting on the chisel-pointed protrusion; and d. an outer housing that envelopes and is affixed to the adapter tube, wherein the outer housing has a shape that resembles a standard shotgun shell hull.

2. A cartridge adapter for firing subcaliber rim-fire shot cartridges in a standard shotgun, wherein the adapter comprises:

a. an adapter tube having upper and lower ends, wherein the tube has a central passageway for housing and totally enclosing a subcaliber cartridge, said passageway having at least one stepped, widened portion adjacent the tube's lower end for retaining the base of the cartridge;

b. a firing pin mechanism removably located within the stepped portion, said mechanism comprising:

i. a cylindrical breech bushing removably housed within the stepped portion, said bushing having a central throughbore with a widened portion adjacent the tube's lower end;

ii. a secondary firing pin slidably housed within the bushing's throughbore, said secondary firing pin having a T-shaped piston configuration comprised of a vertical stem, slidably retained inside the throughbore by a spring-biased midportion, and an integral horizontal portion that normally sits atop the breech bushing, said horizontal portion having an upper face with a chisel-pointed protrusion along the rim of that face;

iii. wherein the stem has substantially the same diameter as that of a primary firing pin in the standard shot gun and is slightly shorter than the length of the breech bushing, and wherein a free end of the stem is adjacent the lower end of the breech bushing but recessed slightly therefrom inside the throughbore; and c. an outer housing that envelopes and is affixed to the adapter tube, wherein the outer housing has a shape that resembles a standard shotgun shell hull.

3. The cartridge adapter of claim 2, wherein the passageway's widened portion includes an annular shoulder vertically spaced above the chisel-pointed protrusion for removably retaining the base of subcaliber ammunition between the protrusion and the shoulder, whereby said base is normally spaced apart and above the entire upper face of the secondary firing pin except for that portion resting on the chisel-pointed protrusion.

4. The cartridge adapter of claim 3, wherein the firing pin mechanism is removably housed within the stepped portion by a ball-and-detent arrangement comprising an annular groove in the outer surface of cylindrical breech bushing; a split spring collar that is housed within a recess of the adapter tube and which surrounds the bushing's annular groove; and a ball that fits between the groove and the split collar inside of a hole in the collar.

5. The cartridge adapter of claim 3, wherein an upper end of the outer housing is secured to the upper end of the adapter tube by a donut shaped end cap and the housing's lower end is also affixed to the tube's lower end.

6. A cartridge adapter for firing subcaliber rim-fire shot cartridges in a standard shotgun, wherein the adapter comprises:

a. an adapter tube having upper and lower ends, wherein the tube has a central passageway that houses and totally encloses said subcaliber cartridge, said passageway having two stepped portions that sucessively widen the passageway adjacent the tube's lower end;

b. a firing pin mechanism removably located within the stepped portions, said mechanism comprising:

i. a cylindrical breech bushing, removably housed within the stepped portion by a ball-and-detent arrangement comprising an annular groove in the outer surface of the cylindrical breech bushing; a split spring collar that is housed within a recess of the adapter tube and which surrounds the bushing's annular groove; and a ball that fits between the groove and the split collar inside of a hole in the collar;

ii. a secondary firing pin slidably housed within a central throughbore of the breech bushing, said secondary firing pin having a T-shaped piston configuration comprised of a vertical stem, slidably retained inside the throughbore by a spring-biased midportion, and an integral horizontal portion that normally sits atop the breech bushing, said horizontal portion having an upper face with a chisel-pointed protrusion along the rim of that face;

iii. wherein the stem has substantially the same diameter as that of a primary firing pin in the standard shotgun and is slightly shorter than the length of the breech bushing, and wherein a free end of the stem is adjacent the lower end of the breech bushing but recessed slightly therefrom inside the throughbore;

c. wherein the adapter tube's passageway has an annular shoulder vertically spaced above the chisel-pointed protrusion for removably retaining the base of subcaliber ammunition between the protrusion and the shoulder, whereby said base is normally spaced apart and above the entire upper face of the secondary firing pin except for that portion resting on the chisel-pointed protrusion; and d. an outer housing that envelopes and is affixed to the adapter tube, wherein the outer housing has a shape that resembles a standard shotgun shell hull.

7. A cartridge adapter for firing subcaliber rim-fire shot cartridges in a standard shotgun, wherein the adapter comprises:

a. an adapter tube having upper and lower ends, wherein the tube has a central passageway that houses and totally encloses said subcaliber cartridge, said passageway, having two stepped portions that successively widen the passageway adjacent the tube's lower end;

b. a firing pin mechanism removably located within the stepped portions by a ball-and-detent arrangement, said mechanism comprising:

i. a cylindrical breech bushing removably housed within the stepped portions, said bushing having a central throughbore;

ii. a secondary firing pin slidably housed within the bushing's throughbore, said secondary firing pin having a T-shaped piston configuration comprised of a vertical stem, slidably retained inside the throughbore by a spring-biased midportion, and an integral horizontal portion that normally sits atop the breech bushing, said horizontal portion having an upper face with a chisel-pointed protrusion along the rim of that face;

iii. wherein the stem has substantially the same diameter as that of a primary firing pin in the standard shotgun and is slightly shorter than the length of the breech bushing, and wherein a free end of the stem is adjacent the lower end of the breech bushing but recessed slightly therefrom inside the throughbore;

c. wherein the adapter tube's passageway has an annular shoulder vertically spaced above the chisel-pointed protrusion for removably retaining the base of subcaliber ammunition between the protrusion and the shoulder, whereby said base is normally spaced apart and above the entire upper face of the secondary firing pin except for that portion resting on the chisel-pointed protrusion; and d. an outer housing that envelopes and is affixed to the adapter tube, wherein the outer housing has a shape that resembles a standard shotgun shell hull.

* * * * *